US008018444B2

(12) United States Patent
Park et al.

(10) Patent No.: US 8,018,444 B2
(45) **Date of Patent: *Sep. 13, 2011**

(54) DATA DRIVING CIRCUIT, ORGANIC LIGHT EMITTING DISPLAY DEVICE USING THE SAME, AND DRIVING METHOD OF ORGANIC LIGHT EMITTING DISPLAY DEVICE

(75) Inventors: Yong Sung Park, Seoul (KR); Oh Kyong Kwon, Seoul (KR)

(73) Assignees: Samsung Mobile Display Co., Ltd., Yongin (KR); IUCF-HYU (Industry-University Cooperation Foundation Hanyang University), Seoul (KR)

( * ) Notice: Subject to any disclaimer, the term of this patent is extended or adjusted under 35 U.S.C. 154(b) by 913 days.

This patent is subject to a terminal disclaimer.

(21) Appl. No.: 11/518,042

(22) Filed: Sep. 7, 2006

(65) Prior Publication Data

US 2007/0091031 A1 Apr. 26, 2007

(30) Foreign Application Priority Data

Oct. 25, 2005 (KR) ..... 10-2005-0100880

(51) Int. Cl.
*G09G 5/00* (2006.01)

(52) U.S. Cl. ..... 345/204; 345/690; 345/76; 345/77; 345/82; 315/169.3

(58) Field of Classification Search ..... 345/89, 345/76, 77, 82, 83, 88, 100, 204, 690, 691; 327/333; 315/169.3

See application file for complete search history.

(56) References Cited

U.S. PATENT DOCUMENTS

| | | | | |
|---|---|---|---|---|
| 6,229,583 | B1 * | 5/2001 | Yasunishi | 349/33 |
| 2002/0149608 | A1 * | 10/2002 | Bu et al. | 345/690 |
| 2003/0058233 | A1 * | 3/2003 | Ahn et al. | 345/211 |
| 2003/0090451 | A1 | 5/2003 | Ahn | |

(Continued)

FOREIGN PATENT DOCUMENTS

JP 8-044313 2/1996

(Continued)

OTHER PUBLICATIONS

Patent Abstract of Japan for Japanese Publication No. 08-044313, published on Feb. 16, 1996 in the name of Isato Denda, et al.

(Continued)

*Primary Examiner* — Lin-Yi Lao
*Assistant Examiner* — Priyank Shah
(74) *Attorney, Agent, or Firm* — Christie, Parker & Hale, LLP

(57) ABSTRACT

A data driving circuit for displaying uniform images, a light emitting display device using the same, a driving method thereof. The data driving circuit includes a holding latch part including a plurality of holding latches for storing data, a signal generation part including a plurality of digital-analog converters for receiving the data and for generating data signals, a first switching part located between the holding latch part and the signal generation part, and a second switching part electrically connected to the signal generation part, the second switching part being for transmitting the data signals to data lines, wherein the first switching part electrically connects the respective holding latches to the respective digital-analog converters differently during a previous frame than during a current frame. As such, the data driving circuit may diffuse errors of the digital-analog converters to display uniform images.

19 Claims, 11 Drawing Sheets

U.S. PATENT DOCUMENTS

| | | | | |
|---|---|---|---|---|
| 2004/0056852 | A1* | 3/2004 | Shih et al. | 345/204 |
| 2004/0104873 | A1* | 6/2004 | Kang et al. | 345/87 |
| 2004/0125067 | A1* | 7/2004 | Kim et al. | 345/98 |
| 2004/0257356 | A1* | 12/2004 | Koyama | 345/204 |
| 2005/0007315 | A1 | 1/2005 | Yang et al. | |
| 2005/0024299 | A1* | 2/2005 | Abe et al. | 345/76 |
| 2005/0110727 | A1 | 5/2005 | Shin | |
| 2005/0156862 | A1* | 7/2005 | Hirayama et al. | 345/100 |
| 2005/0264495 | A1* | 12/2005 | Shin | 345/76 |

FOREIGN PATENT DOCUMENTS

| | | | |
|---|---|---|---|
| JP | 9-24641 | | 1/1997 |
| JP | 10-319924 | A | 12/1998 |
| JP | 11-167373 | A | 6/1999 |
| JP | 2000-206936 | | 7/2000 |
| JP | 2001-056664 | | 2/2001 |
| JP | 2001-175228 | | 6/2001 |
| JP | 2001-242839 | | 9/2001 |
| JP | 2002-328644 | | 11/2002 |
| JP | 2003-140614 | | 5/2003 |
| JP | 2003-195812 | | 7/2003 |
| JP | 2003-255880 | | 9/2003 |
| JP | 2003-271097 | A | 9/2003 |
| JP | 2003-280616 | | 10/2003 |
| JP | 2004-272191 | | 9/2004 |
| KR | 10-2004-0021753 | | 3/2004 |
| KR | 10-2004-0041339 | | 5/2004 |
| KR | 10-2004-0077191 | | 9/2004 |
| KR | 10-2005-0051850 | | 6/2005 |

OTHER PUBLICATIONS

Patent Abstract of Japan for Japanese Publication No. 2001-175228, published Jun. 29, 2001 in the name of Fumihiko Kato.

Korean Patent Abstract for Korean Publication No. 1020040021753 A, published Mar. 11, 2004 in the name of Oh Kyoung Kwon.

Japanese Office action dated Dec. 1, 2009, for corresponding Japanese application 2006-186960, noting listed Japanese references in this IDS.

U.S. Office action dated Mar. 18, 2009, for related U.S. Appl. No. 11/404,560, noting listed U.S. Publications in this IDS.

Japanese Office action dated Mar. 23, 2010, for corresponding Japanese Patent application 2006-186960, noting listed reference in this IDS, as well as other Japanese references previously filed in an IDS dated Feb. 2, 2010.

* cited by examiner

【FIG. 1】
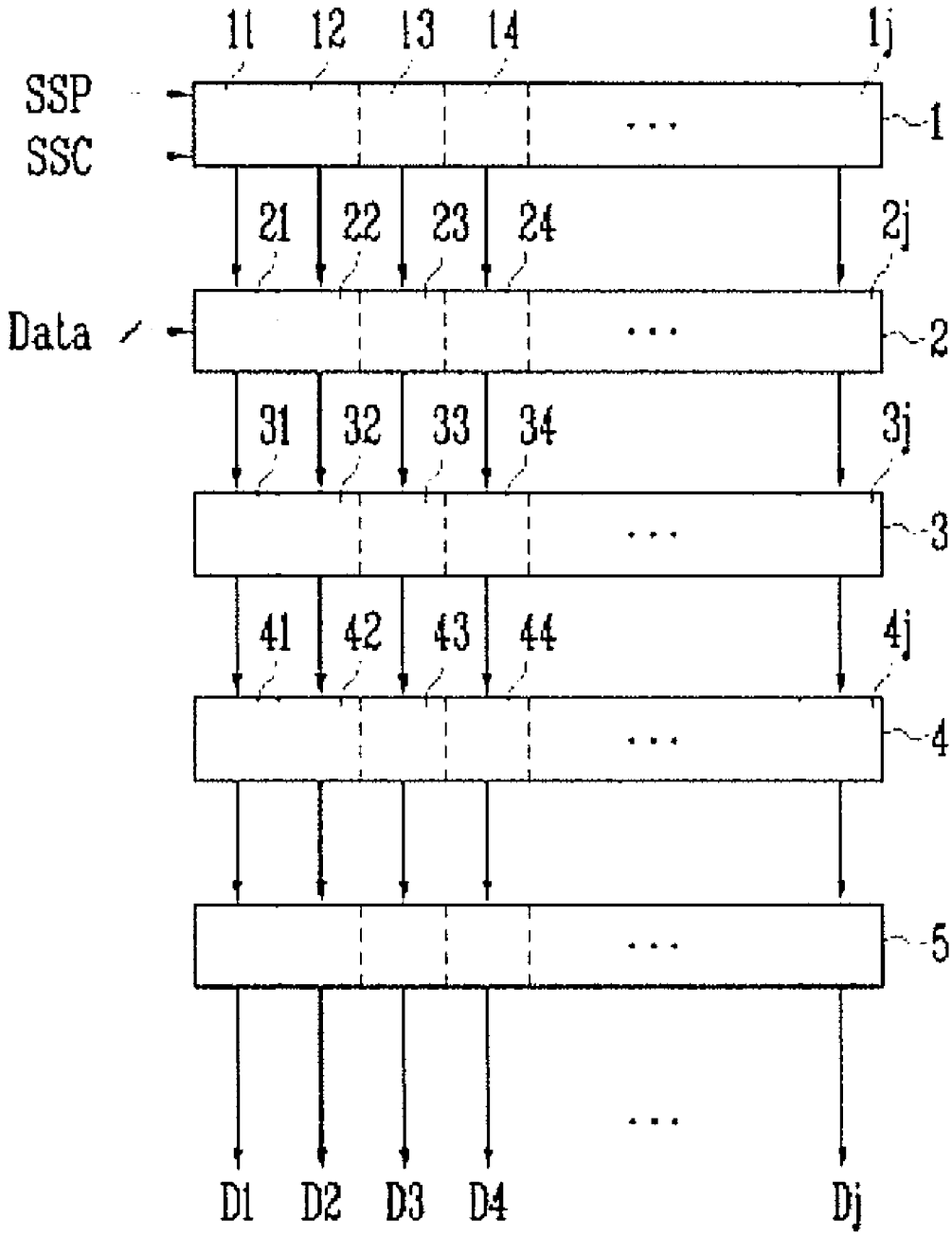

【FIG. 2】
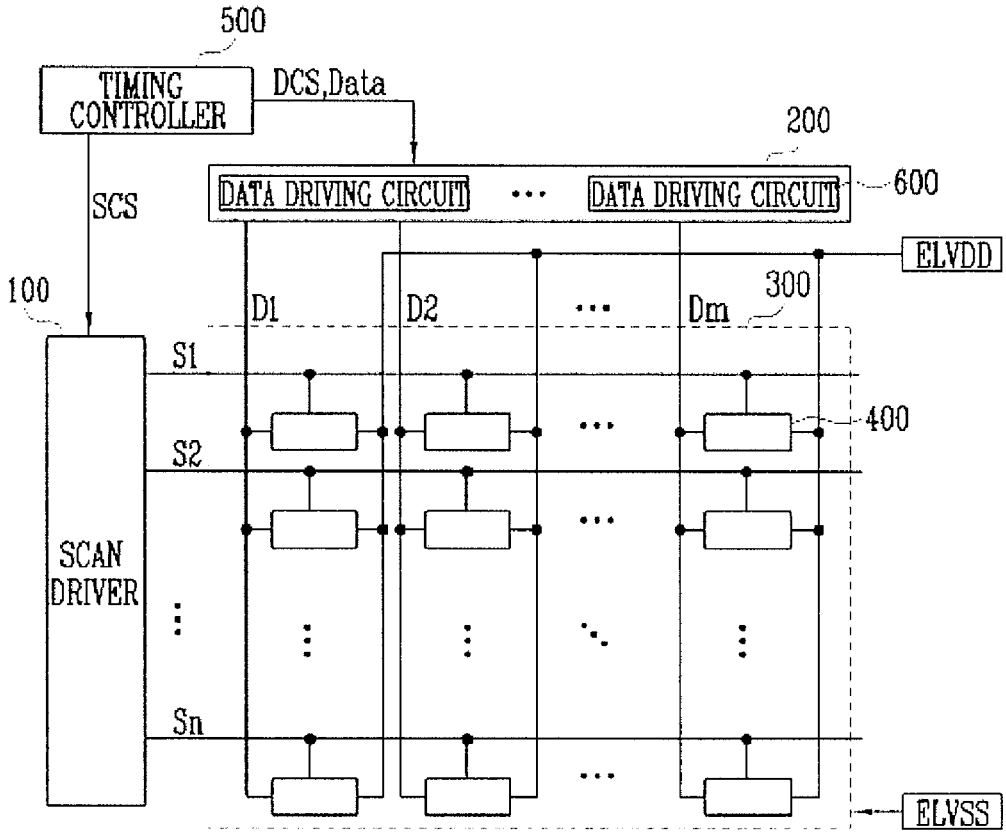

【FIG. 3】
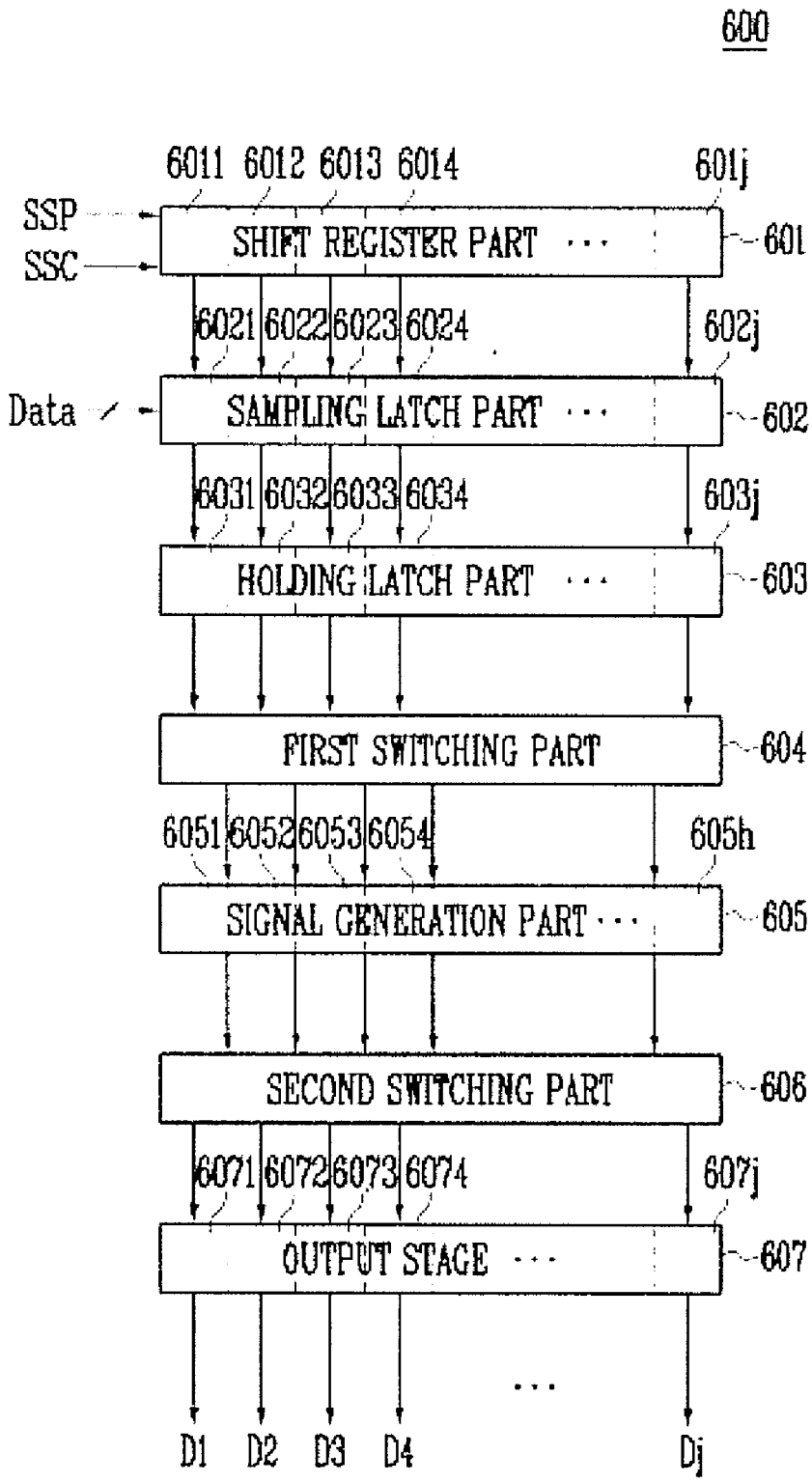

【FIG. 5a】
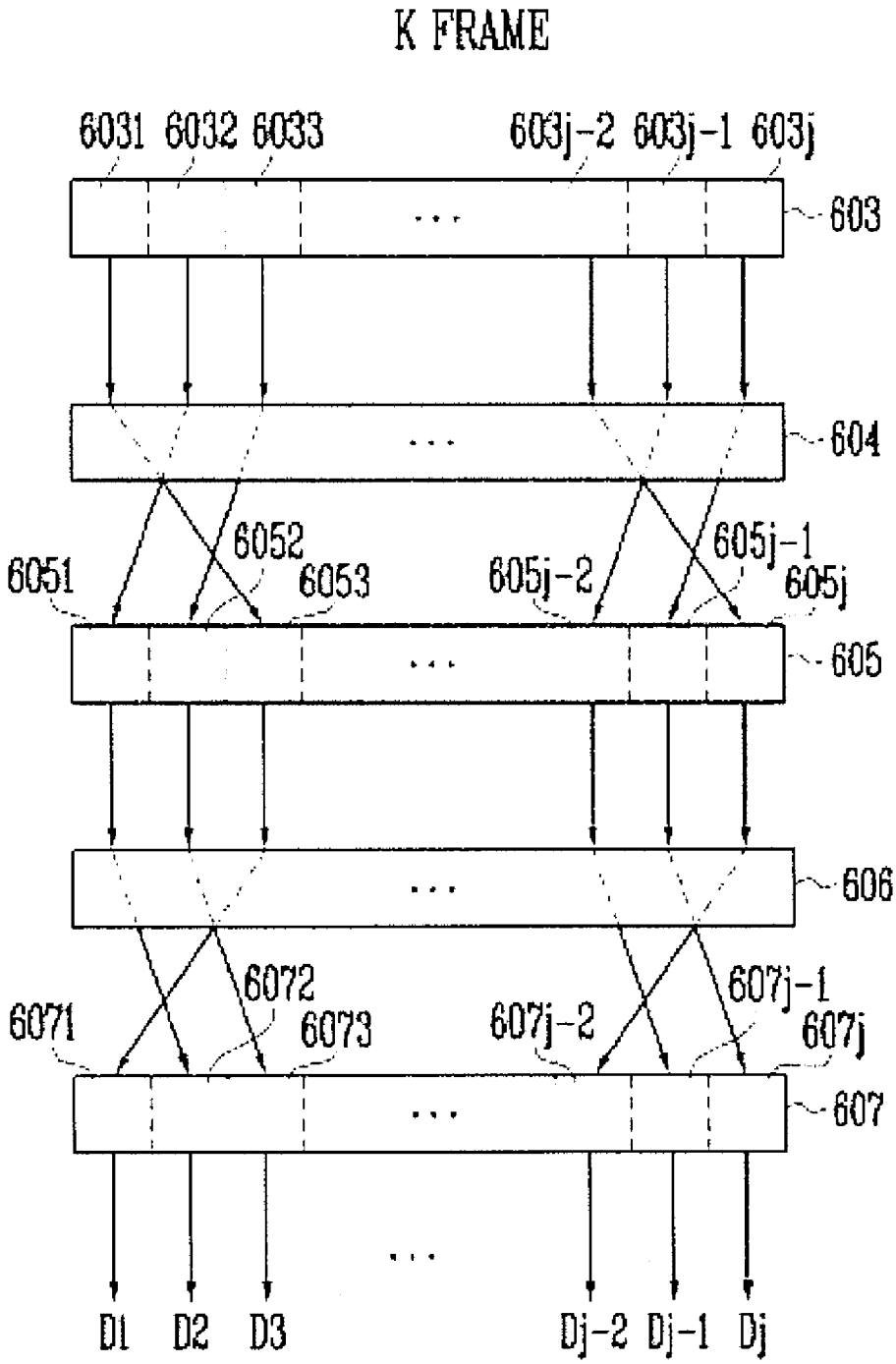

【FIG. 5b】
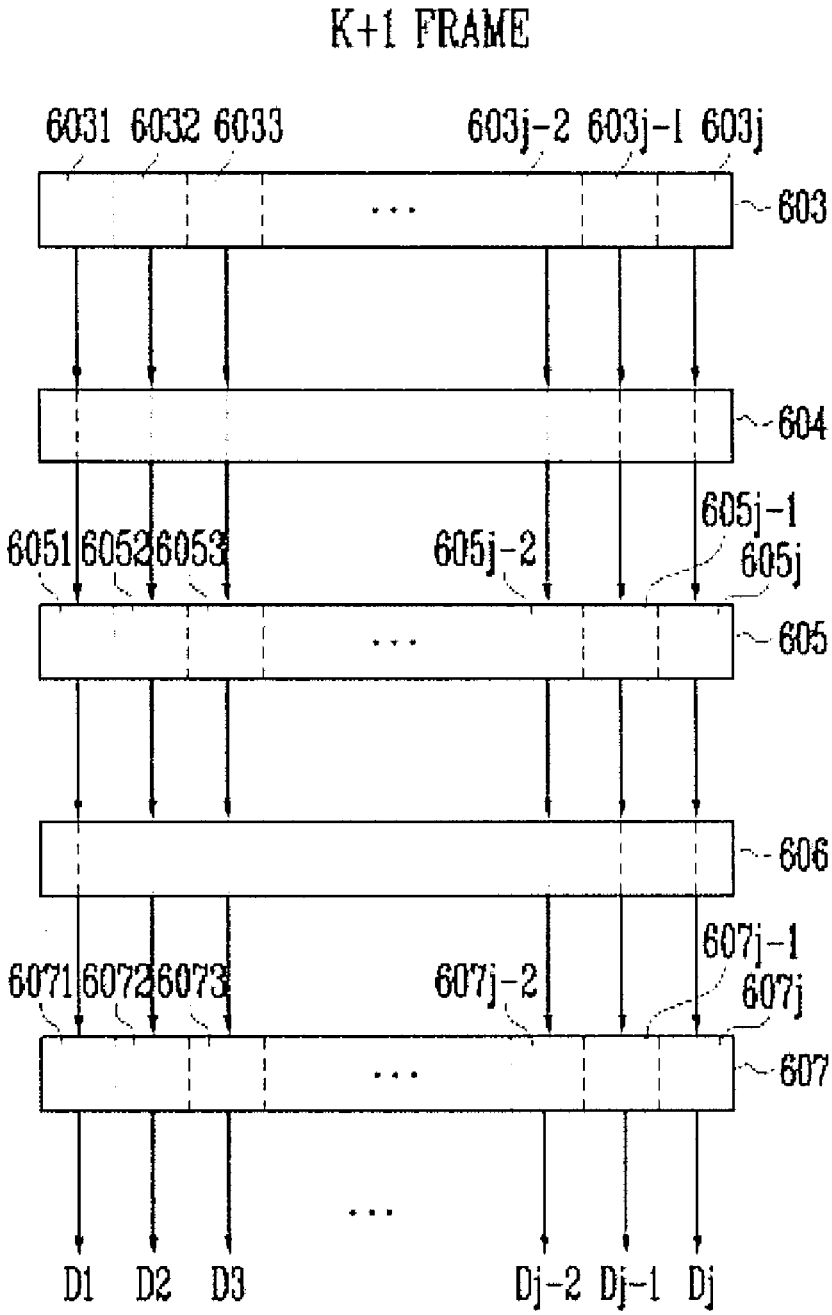

【FIG. 5c】
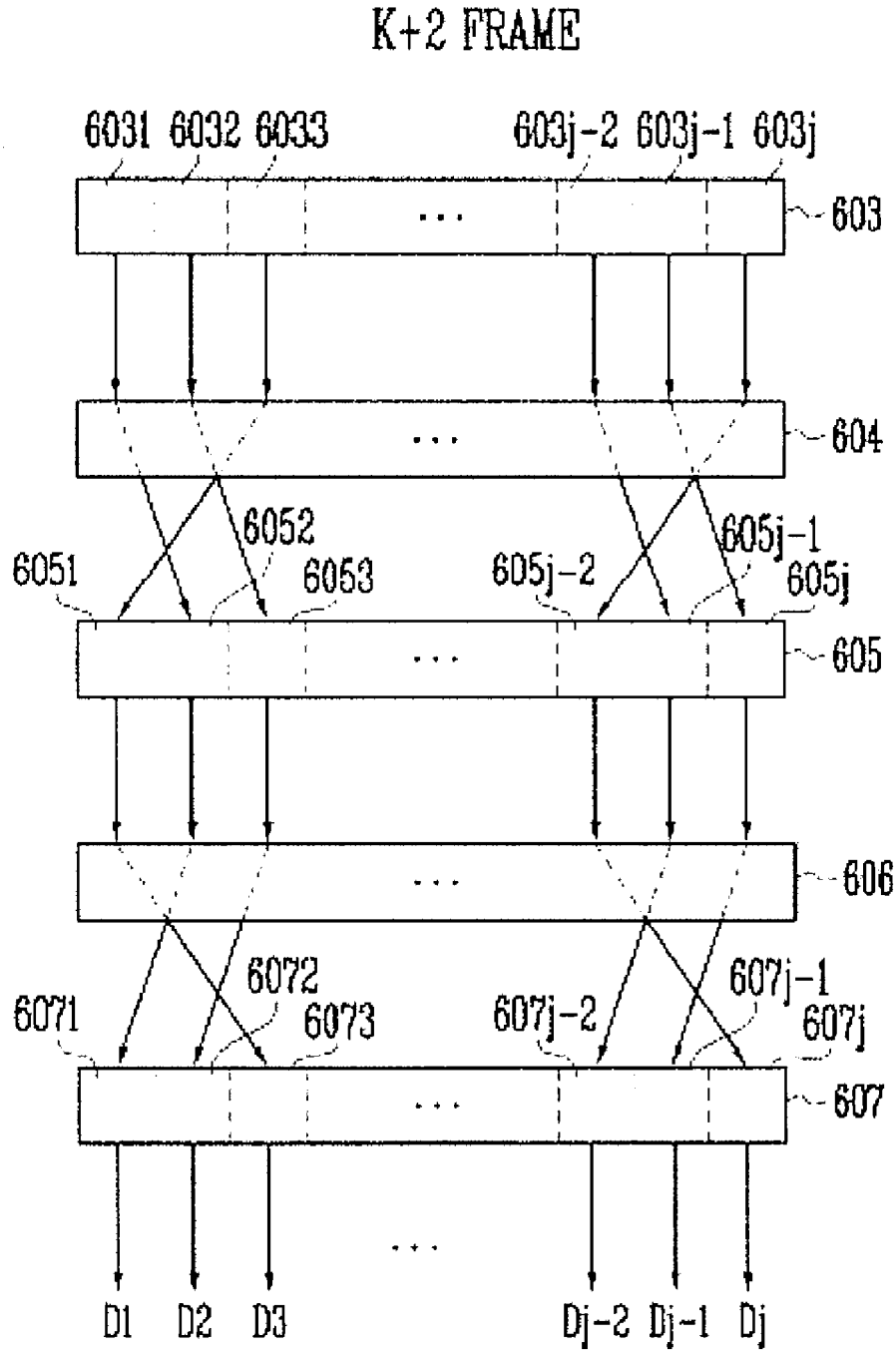

【FIG. 6】
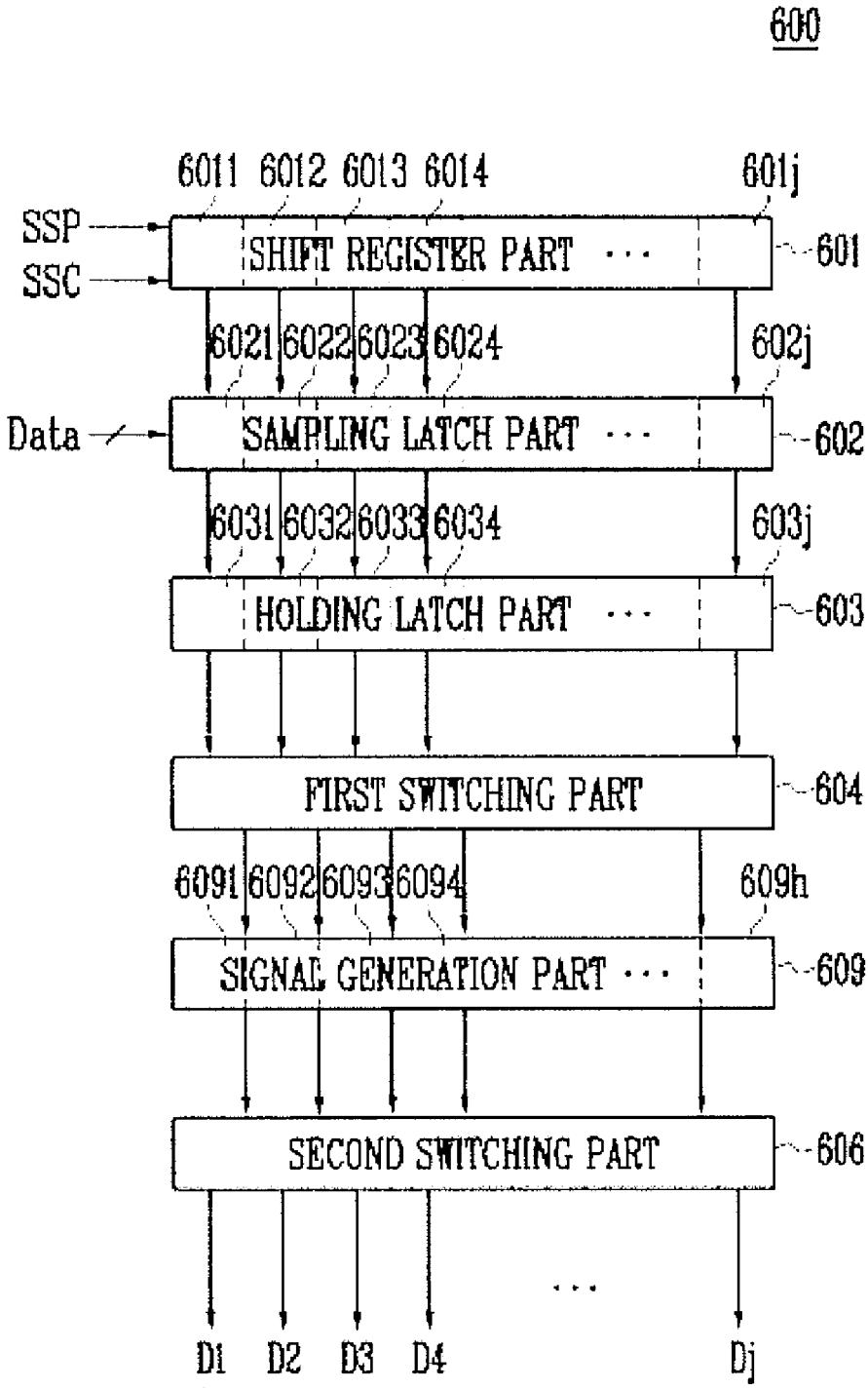

【FIG. 7】
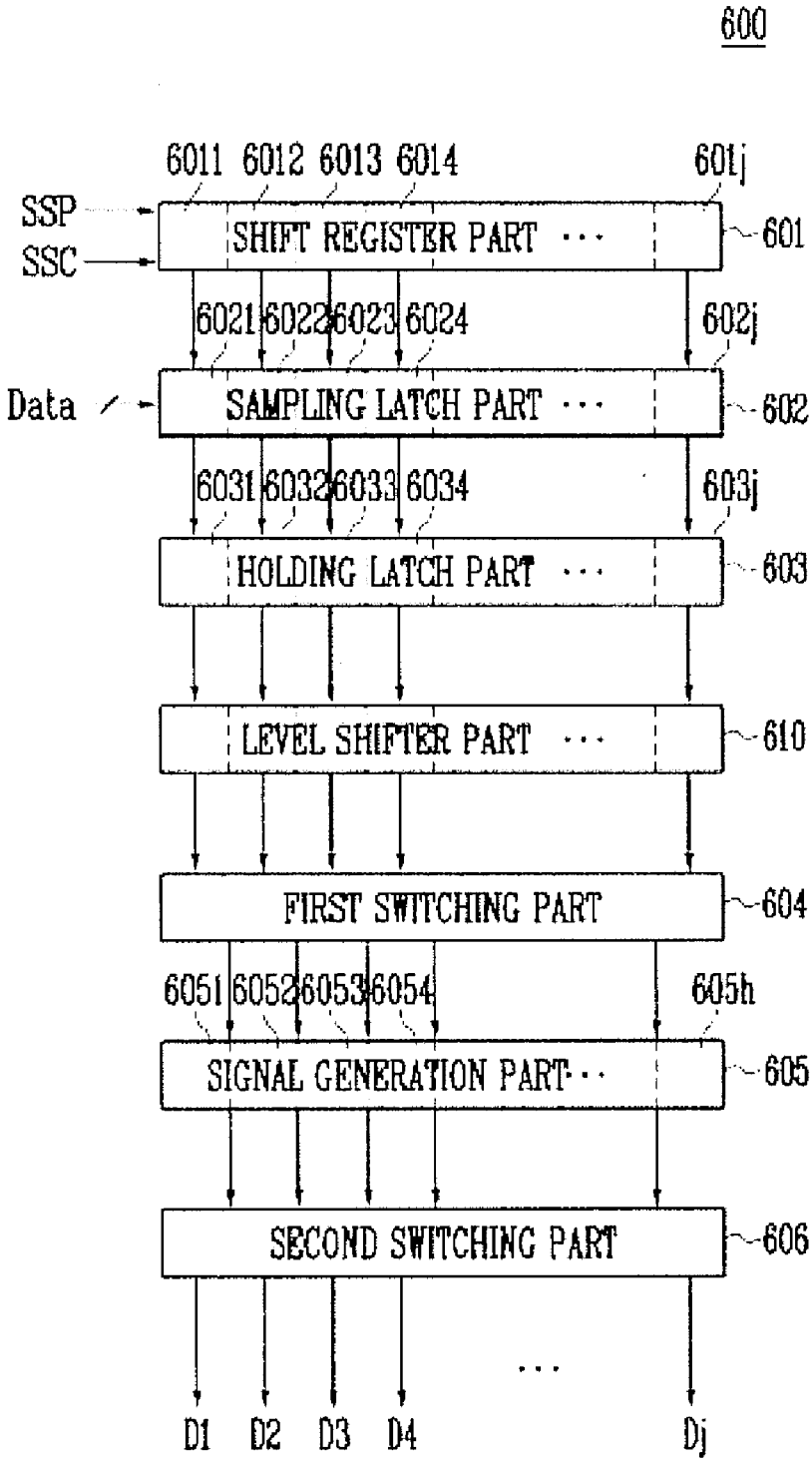

DATA DRIVING CIRCUIT, ORGANIC LIGHT EMITTING DISPLAY DEVICE USING THE SAME, AND DRIVING METHOD OF ORGANIC LIGHT EMITTING DISPLAY DEVICE

CROSS-REFERENCE TO RELATED APPLICATION

This application claims priority to and the benefit of Korean Patent Application No. 10-2005-0100880, filed on Oct. 25, 2005, in the Korean Intellectual Property Office, the entire content of which is incorporated herein by reference.

BACKGROUND

1. Field of the Invention

The present invention relates to a data driving circuit, a light emitting display device using the same, and a driving method thereof, and more particularly, to a data driving circuit, a light emitting display device using the same, and a driving method thereof, from which uniform images can be displayed.

2. Discussion of Related Art

An organic light emitting display device is a flat display device that displays images using organic light emitting diode OLEDs for generating light by a recombination of electrons and holes. The organic light emitting display device has a rapid response speed and can be driven with low power consumption.

The organic light emitting display device includes a plurality of pixels located in crossing (or intersection) regions defined by data lines and scan lines. The pixels are selected when scan signals are supplied to the scan lines and are charged with voltages corresponding to data signals supplied to the data lines. The pixels generate lights with a certain (or predetermined) brightness by supplying currents corresponding to the charged voltages to organic light emitting diodes. Here, the lights with the predetermined brightness emitted from each of the pixels are summed to display images in a display region.

In addition, the organic light emitting display device includes a data driver for supplying the data signals to the data lines, and a scan driver for supplying the scan signals to the scan lines. The data driver includes at least one data driving circuit with a predetermined channel (or an output channel).

FIG. 1 is a view illustrating a conventional data driving circuit. For the convenience of description, it is assumed in FIG. 1 that the data driving circuit has j channels (or j output channels) (where j is a natural number).

Referring to FIG. 1, the conventional data driving circuit includes a shift register part 1, a sampling latch part 2, a holding latch part 3, a signal generation part 4, and an output stage 5.

The shift register part 1 is supplied with an external source start pulse SSP and an external source shift clock SSC. The shift register part 1 supplied with the source shift clock SSC and the source start pulse SSP sequentially generates j sampling signals while shifting the source start pulse SSP for every period of the source shift clock SSC. Here, the shift register part 1 includes j shift registers 11 to 1j.

The sampling latch part 2 sequentially stores data corresponding to the sampling signals sequentially supplied from the shift register part 1. Here, the sampling latch part 2 includes j sampling latches 21 to 2*j* to store j data.

The holding latch part 3 is inputted with and stores data from the sampling latch part 2. The holding latch part 3 supplies its stored data to the signal generator part 4. Here, the holding latch part 3 includes j holding latches 31 to 3*j*.

The signal generation part 4 is inputted with data (or digital data) supplied from the holding latch part 3 and then generates j data signals (or j analog data signals) corresponding to the inputted data. Here, the signal generator 4 includes j digital-analog converters (hereinafter, referred to as "DAC") 41 to 4*j*. That is, the signal generator 4 generates j data signals using the DACs 41 to 4*j* located in each of the channels, and supplies the generated data signals to the output stage 5.

The output stage 5 supplies j data signals supplied from the signal generator 4 to j data lines D1 to D*j*, respectively. Then, the data signals are supplied to the pixels, displaying predetermined images.

However, the conventional data driving circuit has a problem in that uniform data signals cannot be generated due to a variation of DACs 41 to 4*j* located in each of the channels. In practice, although the process procedure for manufacturing the DACs 41 to 4j is controlled precisely during the manufacturing of the DACs 41 to 4j, the DACs 41 to 4j still have a variation of about +3 mV between their outputs. Therefore, although data with the same gray level value is inputted to each of the DACs 41 to 4j, data with different voltage values (or current values) are generated. As such, if the data signals with different voltage values (or current values) are generated when the same gray level values are inputted to each of the DACs 41 to 4*j*, then the light emitting display device displays non-uniform images. In particular, if the DACs 41 to 4*j* with a certain amount of the variation are arranged adjacent to one another, then stripe-type noises can be added to the images.

SUMMARY OF THE INVENTION

Therefore, an aspect of the present invention provides a data driving circuit, a light emitting display device using the same, a driving method thereof, from which uniform images can be displayed.

A data driving circuit according to an embodiment of the present invention includes a holding latch part including a plurality of holding latches for storing data, a signal generation part including a plurality of digital-analog converters for receiving the data and for generating data signals, a first switching part located between the holding latch part and the signal generation part, and a second switching part electrically connected to the signal generation part, the second switching part being for transmitting the data signals to data lines, wherein the first switching part electrically connects the respective holding latches to the respective digital-analog converters differently during a previous frame than during a current frame.

In one embodiment, the signal generation part includes a first number of the digital-analog converters, the holding latch part includes a second number of the holding latches, and the first number is greater than the second number.

In one embodiment, the first switching part shifts the data to a first direction or a second direction opposing the first direction by one or more channels during a previous frame, and the first switching part does not shift the data during a current frame.

In one embodiment, the signal generation part includes a first number of the digital-analog converters, the holding latch part includes a second number of the holding latches, and the first number is equal to the second number.

In one embodiment, the first switching part shifts a part of the data to a first direction by one or more channels and shifts a remaining part of the data to a second direction opposing the first direction by one or more channels during a previous frame, and the first switching part does not shift the data during a current frame.

In one embodiment, the second switching part transmits the data signals generated by the data located in an ith one of the holding latches to an ith one of the data lines, and i is a natural number.

A light emitting display device according to an embodiment of the present invention includes a scan driver for driving scan signals of scan lines, a data driver for driving data signals of data lines, and a display region including a plurality of pixels electrically connected to the scan lines and the data lines, wherein a data driving circuit of the data driver includes a holding latch part including a plurality of holding latches for storing data, a signal generation part including a plurality of digital-analog converters for receiving the data and for generating the data signals, a first switching part located between the holding latch part and the signal generation part, and a second switching part connected to the signal generation part, the second switching part being for transmitting the data signals to data lines, wherein the first switching part connects the respective holding latches to the respective digital-analog converters differently during a previous frame than during a current frame.

In one embodiment, the second switching part transmits the data signals generated by the data located in an ith one of the holding latches to an ith one of the data lines, and i is a natural number.

A driving method of a light emitting display device according to an embodiment of the present invention including: generating a plurality of data signals using a plurality of digital-analog converters; supplying the data signals via a plurality of data lines to a plurality of pixels; and generating light in the pixels corresponding to the data signals, wherein a first digital-analog converter for supplying at least one of the data signals to a specific one of the data lines during a current frame is set up to be different from a second digital-analog converter for supplying the at least one of the data signals to the specific one of the data lines during a previous frame.

In one embodiment, the generating the plurality of data signals includes: storing data in a plurality of holding latches; shifting the data stored in each of the holding latches during at least one of the previous and current frames to supply the data to the digital-analog converters; generating the data signals using the data; and shifting the data signals during the at least one of the previous and current frames to supply the data signals to the data lines.

BRIEF DESCRIPTION OF THE DRAWING

The accompanying drawings, together with the specification, illustrate exemplary embodiments of the present invention, and, together with the description, serve to explain the principles of the present invention.

FIG. 1 is a view that illustrates a conventional data driving circuit.

FIG. 2 is a view that illustrates a light emitting display device according to an embodiment of the present invention.

FIG. 3 is a view that illustrates a first embodiment of a data driving circuit shown in FIG. 2.

DETAILED DESCRIPTION

Figure 4A:
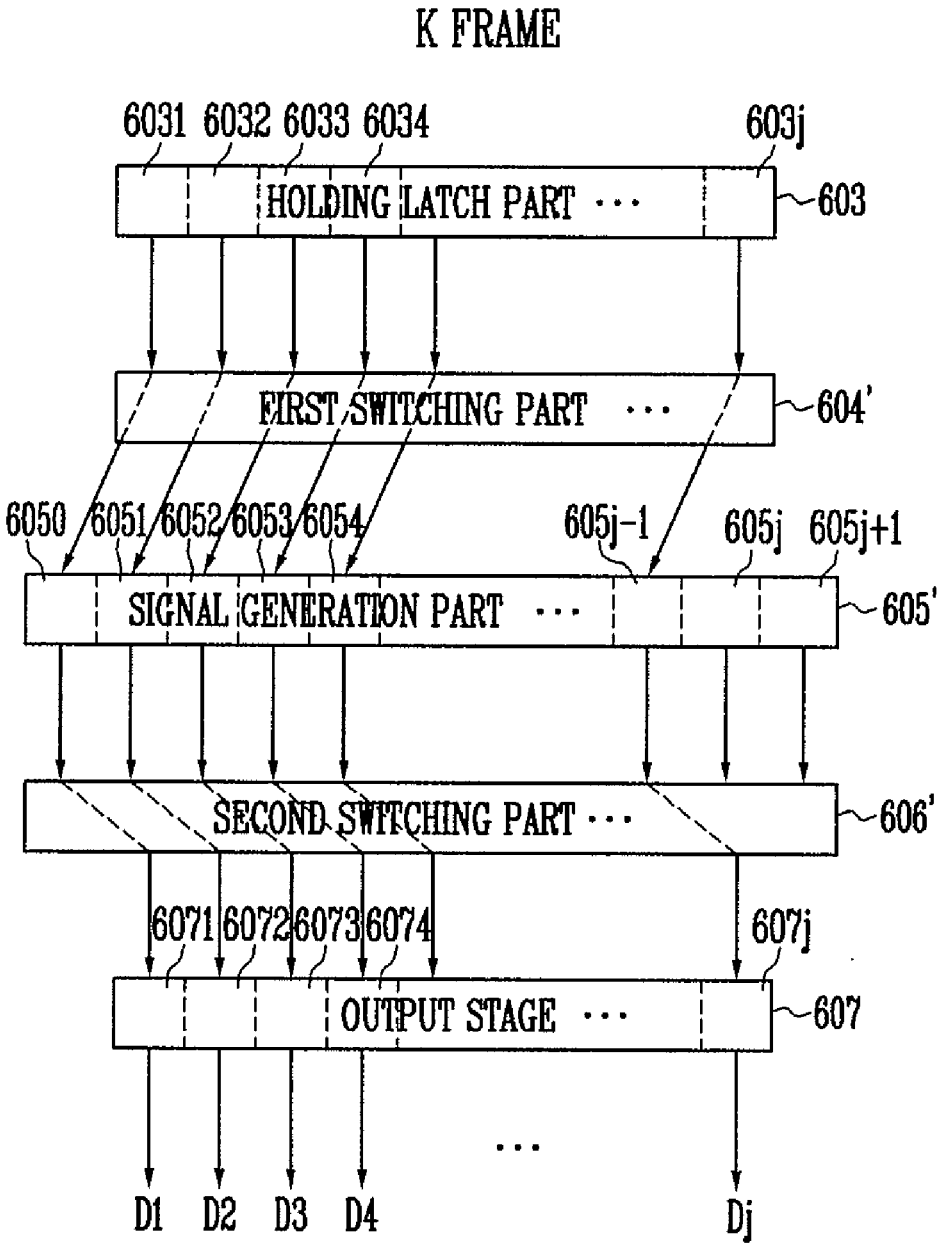
FIGS. 4A, 4B, and 4C are views that illustrate an embodiment of an operational procedure of a first switching part and a second switching part that can be used in the data driving circuit of FIG. 3.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

FIG. 2 is a view that illustrates a light emitting display device according to an embodiment of the present invention.

Referring to FIG. 2, the light emitting display device includes a display region 300 including a plurality of pixels 400 connected to scan lines S1 to Sn and data lines D1 to Dm, a scan driver 100 for driving the scan lines S1 to Sn, a data driver 200 for driving the data lines D1 to Dm, and a timing controller 500 for controlling the scan driver 100 and the data driver 200.

The timing controller 500 generates data driving control signals DCS and scan driving control signals SCS corresponding to externally supplied synchronization signals. The data driving control signals DCS generated in the timing controller 500 are supplied to the data driver 200, and the scan driving control signals SCS are supplied to the scan driver 100. In addition, the timing controller 500 supplies externally supplied data to the data driver 200.

The scan driver 100 is supplied with the scan driving control signals SCS from the timing controller 500. The scan driver 100 supplied with the scan driving control signals SCS sequentially supplies the scan signals to the scan lines S1 to Sn. That is, the scan driver 100 selects pixels 400 to be supplied with data signals by sequentially supplying the scan signals to the scan lines S1 to Sn.

The data driver 200 is supplied with the data driving control signals DCS from the timing controller 500. The data driver 200 supplied with the data driving control signals DCS generates currents or voltages (which may be predetermined) as data signals corresponding to the gray level values of the data. For example, in a case where predetermined voltages are generated as the data signals, the data driver 200 supplies the data signals to the pixels 400 selected by the scan signals. Also, in a case where predetermined currents are generated as the data signals, the data driver 200 is supplied with the predetermined currents from the pixels 400 selected by the scan signals (Current Sink). In either case, the data driver 200 includes at least one data driving circuit 600, which will be described later in more detail.

The display region 300 includes pixels 400 formed in the crossing (or intersection) regions defined by the scan lines S1 to Sn and the data lines D1 to Dm. Each of the pixels 400 is supplied with a first power of a first power source ELVDD and a second power of a second power source ELVSS. The pixels 400 charge voltages (or predetermined voltages) corresponding to the data signals and supply currents corresponding to the charged voltages from the first power source ELVDD via organic light emitting diodes (not shown) to the second power source ELVSS to display images with a brightness (or a certain brightness or a predetermined brightness).

FIG. 3 is a view that illustrates a data driving circuit 600 of FIG. 2 according to a first embodiment of the present invention. For the convenience of description, the data circuit 600 of FIG. 3 is shown to have j channels (or j output channels).

Referring to FIG. 3, the data driving circuit 600 includes a shift register part 601, a sampling latch part 602, a holding latch part 603, a first switching part 604, a signal generation part 605, a second switching part 606, and an output stage 607.

The shift register part 601 is supplied with an external source start pulse SSP and an external source shift clock SSC. The shift register part 601 supplied with the source shift clock SSC and the source start pulse SSP sequentially generates j sampling signals while shifting the source start pulse SSP for every period of the source shift clock SSC. Here, the shift register part 601 includes j shift registers 6011 to 601*j*.

The sampling latch part 602 sequentially stores data corresponding to the sampling signals sequentially supplied from the shift register part 601. Here, the sampling latch part 602 includes j sampling latches 6021 to 602*j* to store j data. The storing capacity of each of the sampling latches 6021 to 602*j* is capable of storing the data (or predetermined bits of the data).

The holding latch part 603 is inputted with and stores data from the sampling latch part 602. The holding latch part 603 supplies its stored data to the first switching part 604. Here, the holding latch part 603 includes j holding latches 6031 to 603*j*. The storing capacity of each holding latch 6031 to 603*j* is capable of storing the data (or predetermined bits of the data).

The first switching part 604 is supplied with data from the holding latch part 603. The first switching part 604 supplied with the data from the holding latch part 603 transmits the data to the signal generation part 605 having DACs 6051 to 605*h*. Here, the first switching part 604 connects each of the holding latches 6031 to 603*j* to a different one of the DACs 6051 to 605*h* at every frame. For example, the first switching part 604 may connect the first holding latch 6031 to the first DAC 6051 during the kth frame (where k is a natural number), and may connect the first holding latch 6031 to the second DAC 6052 during the k+1th frame.

The signal generation part 605 is inputted with data from the first switching part 604 and then generates data signals corresponding to the inputted data. For this, the signal generation part 605 includes h DACs 6051 to 605*h* (where h is a natural number greater than j). That is, the number of the DACs 6051 to 605*h* included in the signal generation part 605 is set up to be greater than j.

The DACs 6051 to 605*h* included in the signal generation part 605 generate current or voltage values (or predetermined current or voltage values) corresponding to the gray level values of the data. The signal generation part 605, which generates the voltage data signals or current data signals, supplies the generated data signals to the second switching part 606. For example, in a case where voltage data signals are generated in the signal generation part 605, the output stage 607 includes a plurality of buffers 6071 to 607*j*, and in a case where current data signals are generated, the output stage 607 includes a plurality of sample/hold circuits 6071 to 607*j*.

The second switching part 606 is supplied with data signals from the signal generation part 605. The second switching part 606 supplied with data signals from the signal generation part 605 connects the DACs 6051 to 605*h* to different ones of the different buffers 6071 to 607*j* or different ones of the samples/hold circuits 6071 to 607*j* at every frame. For example, the second switching part 606 may connect the first buffer (or the first sample/hold circuit) 6071 to the first DAC 6051 during the kth frame, and may connect the first buffer (or the first sample/hold circuit) 6071 to the second DAC 6052 during the k+1th frame. In practice, the second switching part 606 controls the connection between the signal generation part 605 and the output stage 607 so that the data signals generated by the data stored in the ith holding latch (where i is a natural number) may be supplied to the ith buffer (or the ith sample/hold circuit).

The output stage 607 is supplied with j data signals from the second switching part 606. In the case where the current data signals are supplied to the second switching part 606, the sample/hold circuits 6071 to 607*j* located in the output stage 607 charge the voltages corresponding to the current data signals supplied thereto, and the sample/hold circuits 6071 to 607*j* are supplied with currents (which may be predetermined) from the pixels 400 via the data lines D1 to Dj corresponding to the charged voltages. On the other hand, in the case where the voltage data signals are supplied from the second switching part 606, each of the voltage data signals is supplied via the buffers 6071 to 607*j* to the data lines D1 to Dj.

Figure 4B:
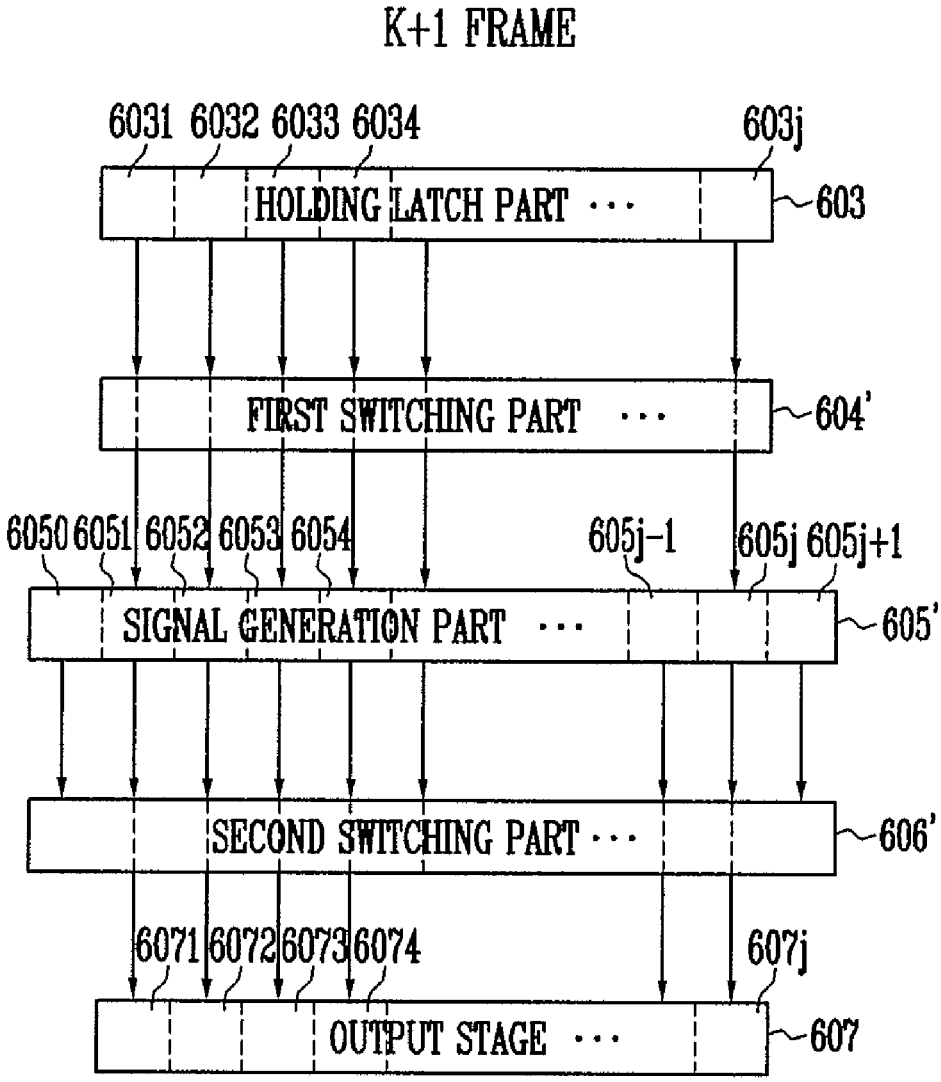
Figure 4C:
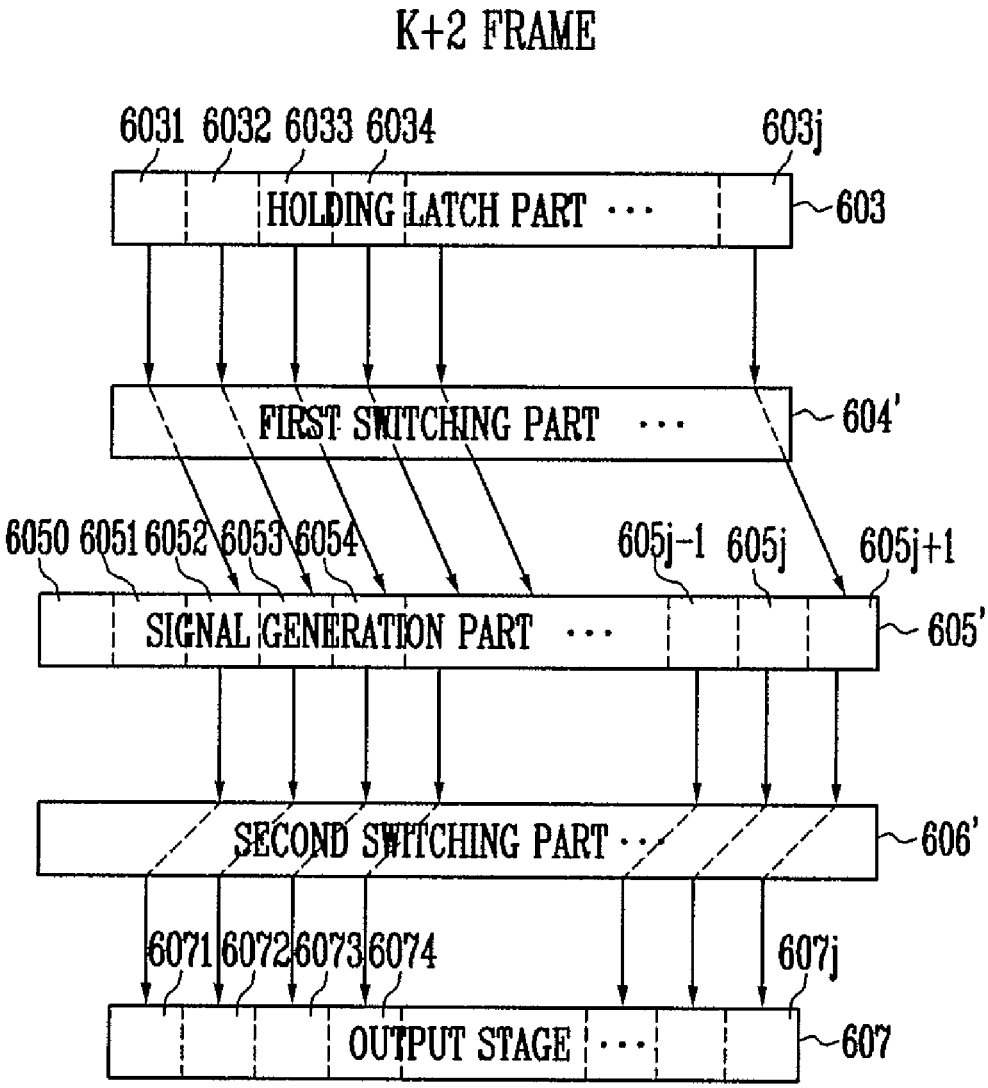

FIGS. 4A to 4C are views that illustrate an embodiment of an operational procedure of a first switching part 604' and a second switching part 606' that can be used in the data driver 600 of FIG. 3. Here, it is assumed that the signal generation part 605' includes DACs 6050 to 605*j*+1 having a number equal to as many as the number of channels (or output channels) plus 2. That is, assuming that the data driver 600 is connected to 100 data lines, the signal generation part 605' includes 102 DACs.

Referring to FIG. 4A, the first switching part 604' shifts the data stored in each of the holding latches 6031 to 603*j* to the left by one channel during the kth frame to supply the data to the DACs 6050 to 605*j*−1. Then, the DACs 6050 to 605*j*−1 generate current data signals or voltage data signals corresponding to their supplied data and supply them to the second switching part 606'. At this time, the second switching part 606' shifts the current data signals or the voltage data signals supplied from the DACs 6050 to 605j−1 to the right by one channel and supplies them to the output stage 607. That is, the second switching part 606' controls the connection between the signal generation part 605' and the output stage 607 so that the data signals generated by the data supplied from ith holding latch may be supplied to the ith data line.

Referring to FIG. 4B, the first switching part 604' supplies the data stored in each of holding latches 6031 to 603*j* to the DACs 6051 to 605*j* located in the original (or un-shifted) channel during the k+1th frame as shown in FIG. 4B. Then, the DACs 6051 to 605*j* generate current data signals or voltage data signals corresponding to their supplied data and supply them to the second switching part 606'. At this time, the second switching part 606' supplies the data signals outputted from the DACs 6051 to 605*j* to the output stage 607, but does not shift the data signals outputted from the DACs 6051 to 605*j*.

Referring to FIG. 4C, the first switching part 604' shifts the data stored in each holding latch 6031 to 603*j* to the right by one channel and supplies them to the DACs 6052 to 605*j*+1. Then, the DACs 6052 to 605*j*+1 generate current data signals or voltage data signals corresponding to their supplied data and supply them to the second switching part 606'. At this time, the second switching part 606' shifts the current data signals or the voltage data signals supplied from the DACs 6052 to 605*j*+1 to the left by one channel and supplies them to the output stage 607.

As described above, the data driving circuit 600 of the present invention sets up the DAC connected to the specific holding latch during the kth frame to be different from the DAC connected to the specific holding latch during the k+1th frame. Accordingly, each of the data lines D1 to Dj is supplied with the data signals generated by the DAC that is different from the DAC used in the previous frame at every frame. As such, if each of the data lines D1 to Dj is supplied with the data signals generated in the DAC that is different from the DAC used in the previous frame at every frame, the display region 300 may display uniform images.

In other words, if the data signals generated in the DACs with a variation (or a predetermined variation) are supplied to the different data lines D1 to Dj at every frame, error diffusion occurs, thus making it possible to display uniform images. On the other hand, the connection procedure of the first and second switching parts 604', 606' of the present invention is not limited to those shown in FIGS. 4A to 4B, and may be modified in various suitable manners so long as each of the data lines D1 to Dj at every frame is supplied with the data signals generated in the DAC that is different from the DAC used in the previous frame at every frame.

Figure 5A:
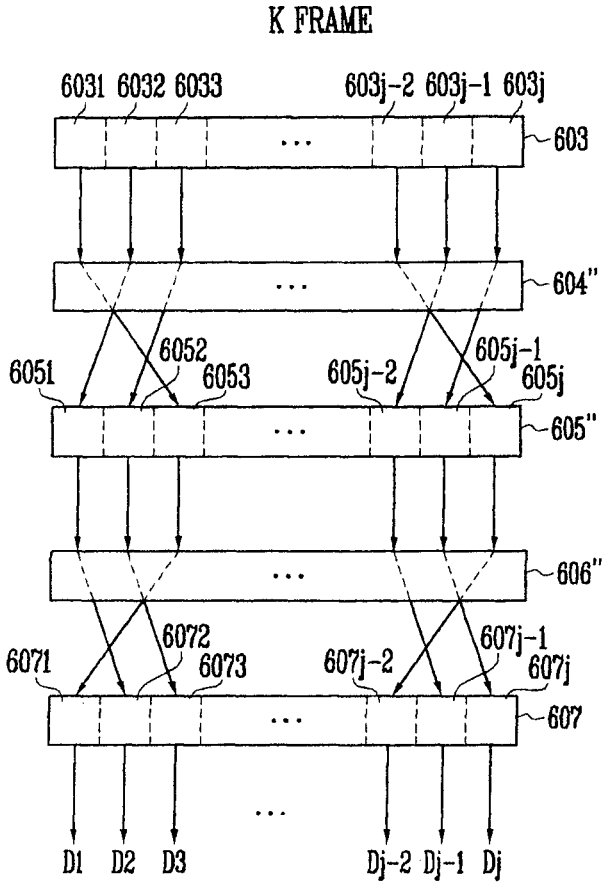
FIGS. 5A, 5B, and 5C are views that illustrate another embodiment of an operational procedure of a first switching part and a second switching part that can be used in the data driving circuit of FIG. 3.
Figure 5B:
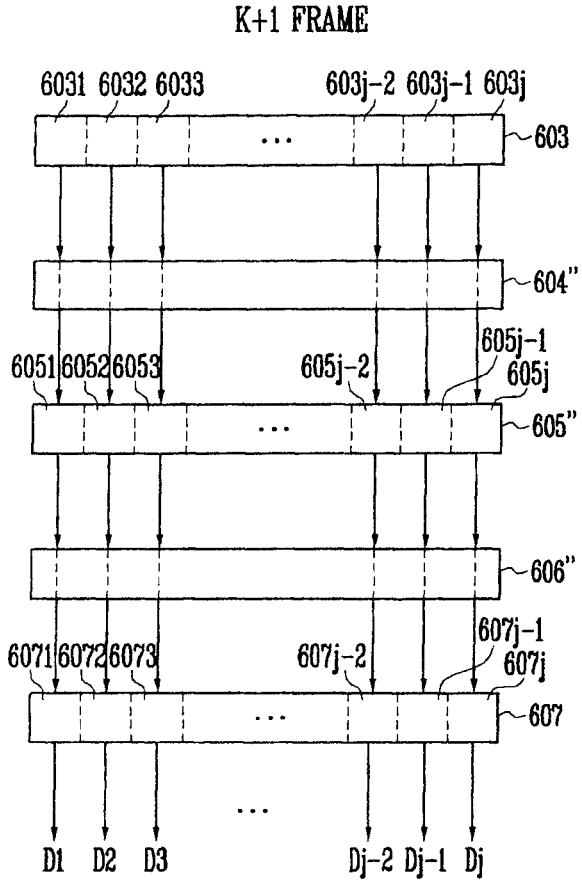
Figure 5C:
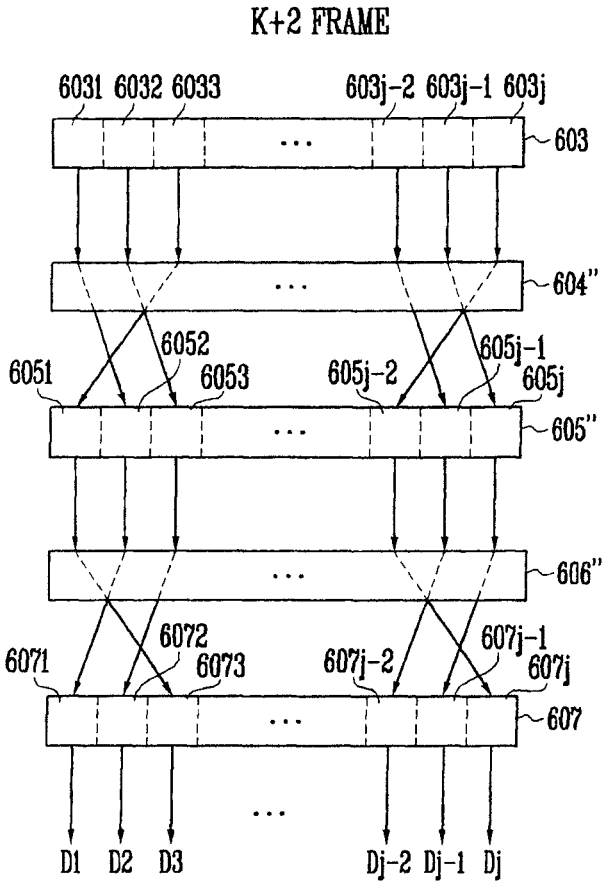

FIGS. 5A to 5C are views that illustrate another embodiment of an operational procedure of a first switching part 604" and a second switching part 606" that can be used in the data driver 600 of FIG. 3. Here, it is assumed that a signal generation part 605" includes DACs 6051 to 605j having a number equal to as many as the number of channels (or output channels).

Referring to FIG. 5A, the first switching part 604" shifts the data stored in parts of the holding latches 6031, . . . . 603*j*−2 (e.g., holding latches 6031, 6034, and 603*j*−2) to the right by two channels during the kth frame and shifts the data stored in the remaining holding latches 6032, 6033, . . . 603*j*−1, 603*j* (e.g., holding latches 6032, 6033, 6035, 6036, and 603*j*−1, 603*j*) to the left by one channel to supply the data to the DACs 6051 to 605*j*. Then, the DACs 6051 to 605*j* generate current data signals or the voltage data signals corresponding to their supplied data and supply them to the second switching part 606". At this time, the second switching part 606" shifts parts of the current data signals or the voltage data signals supplied to the DACs 6051 to 605*j* to the left by two channels and shifts the remaining data signals to the right by one channel to supply the data signals to the output stage 607. That is, the second switching part 606" controls the connection between the signal generation part 605" and output stage 607 so that the data signals generated by the data supplied from the ith holding latch may be supplied to the ith data line.

Referring to FIG. 5B, the first switching part 604" supplies (without shifting) the data stored in each holding latch 6031 to 603*j* to the DACs 6051 to 605*j* located in the original channel during the k+1th frame. Then, the DACs 6051 to 605*j* generate current data signals or voltage data signals corresponding to their supplied data and supply them to the second switching part 606". At this time, the second switching part 606" supplies the data signals outputted from the DACs 6051 to 605*j* to the output stage 607, but does not shift the data signals supplied from the DACs 6051 to 605*j*.

Referring to FIG. 5C, the first switching part 604" shifts the data stored in parts of the holding latches 6033, . . . 603*j* (e.g., holding latches 6033, 6036, and 603*j*) to the left by two channels and shifts the data stored in the remaining holding latches 6031, 6032, . . . 603*j*−2, 603*j*−1 to the right by one channel during the k+2th frame to supply the data to the DACs 6051 to 605*j*. Then, the DACs 6051 to 605*j* generate current data signals or voltage data signals corresponding to their supplied data and supply them to the second switching part 606". At this time, the second switching part 606" shifts parts of the current data signals or the voltage data signals supplied to the DACs 6051 to 605*j* to the right by two channels and shifts the remaining data signals to the left by one channel to supply the data signals to the output stage 607.

As described above, the data driving circuit 600 of the present invention sets up the connection between the holding latch part 603 and the signal generation part 605" during the kth frame to be different from the connection between the holding latch part 603 and the signal generation part 605" during the k+1th frame. Accordingly, each of the data lines D1 to Dj is supplied with the data signals generated by the DAC that is different from the DAC used in the previous frame at every frame. As such, if each of the data lines D1 to Dj is supplied with the data signals generated in the DAC that is different from the DAC used in the previous frame at every frame, the display region 300 may display uniform images.

In other words, if the data signals generated in the DACs with a variation (or a predetermined variation) are supplied to the different data lines D1 to Dj at every frame, error diffusion occurs, thus making it possible to display uniform images. On the other hand, the connection procedure of the first and second switching parts 604", 606" of the present invention is not limited to those shown in FIGS. 5A to 5C, and may be modified in various suitable manners so long as each of the data lines D1 to Dj at every frame is supplied with the data signals generated in the DAC that is different from the DAC used in the previous frame at every frame.

Figure 6:
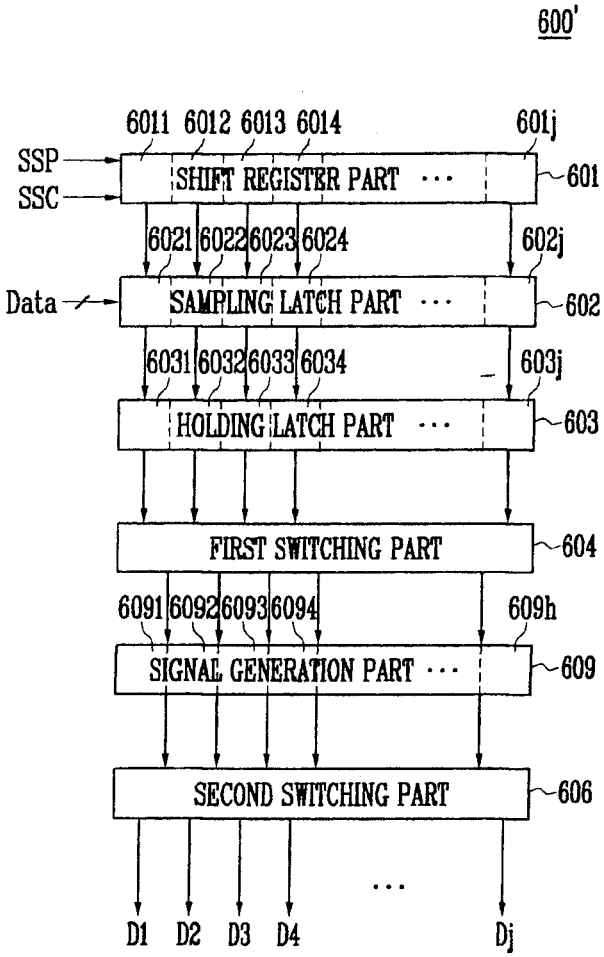
FIG. 6 is a view that illustrates a second embodiment of a data driving circuit.

FIG. 6 is a view that illustrates a data driving circuit 600' according to a second embodiment of the present invention. In describing FIG. 6, parts that are substantially the same as the parts shown and described with reference to FIG. 3 will be assigned the same reference numerals, and the detailed description thereof will be omitted.

Referring to FIG. 6, a signal generation part 609 in the data driving circuit 600' according to the second embodiment of the present invention generates current data signals corresponding to data supplied from the first switching part 604. For this, the signal generation part 609 includes a plurality of DACs 6091 to 609*h*. The DACs 6091 to 609*h*, which generate current data signals, are supplied with currents from the pixels via the second switching part 606 and the data lines D1 to Dj (Current Sink). Then, each of the pixels 400 generates light corresponding to the current supplied to the data driving circuit 600'.

The construction of the second embodiment is substantially identical to that of the first embodiment except that each of the DACs 6091 to 609*h* included in the signal generation part 609 is supplied with the current from the pixels 400 via the second switching part 606 and data lines D1 to Dj. That is, the operational procedures of the first and second switching parts 604, 606 are substantially identical to the first and second switching parts 604', 604", 605', and/or 605" as shown in FIGS. 4A to 5C. However, in the second embodiment of the present invention, the output stage (e.g., 607) is omitted, and the second switching part 606 is directly connected to the data lines D1 to Dj.

Figure 7:
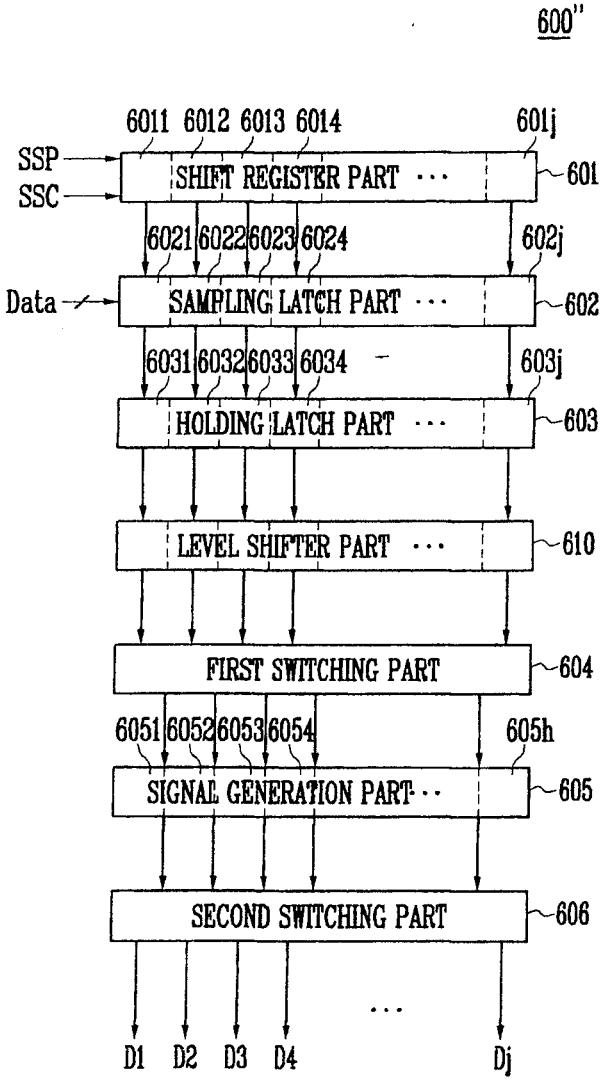
FIG. 7 is a view that illustrates still a third embodiment of a data driving circuit.

FIG. 7 is a view that illustrates a data driving circuit 600" according to a third embodiment of the present invention. In describing FIG. 7, parts that are substantially the same as the parts shown and described with reference to FIG. 3 will be assigned the same reference numerals, and the detailed description thereof will be omitted.

Referring to FIG. 7, the data driving circuit 600" according to the third embodiment of the present invention further includes a level shifter part 610 located to be connected to the holding latch part 603. The level shifter part 610 raises the voltage level of data supplied from the holding latch part 603 and then supplies it to the first switching part 604. By contrast, if data with high voltage level data are supplied from an external system to a data driving circuit, expensive high voltage circuit parts corresponding to the high voltage level need to be used, thus causing the manufacturing cost to be raised. Therefore, in the third embodiment, the data with low voltage level are supplied from an external system to the data driver 600", which in turn are stepped up to high voltage level in the level shifter part 610. As such, low voltage circuit parts corresponding to the low voltage level may be used (in place of the expensive high voltage circuit parts).

As described above, in a data driving circuit, a light emitting display device using the same, and the driving method thereof, the connection between the holding latch part and signal generation part during the previous frame is set up to be different from the connection between the holding latch part and signal generation part during the current frame. Therefore, the data lines are supplied with the data signals generated in the DAC that is different from the DAC used in the previous frame at every frame, which in turn diffuses errors of the DACs, thus making it possible to display uniform images.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A data driving circuit comprising:

a sampling latch part comprising a plurality of sampling latches for sampling data;

a holding latch part comprising a plurality of holding latches for storing all of the data sampled by the sampling latches;

a signal generation part comprising a plurality of digital-to-analog converters for receiving the data and for generating data signals;

a first switching part located between the holding latch part and the signal generation part; and a second switching part coupled to the signal generation part, the second switching part being for transmitting the data signals to data lines, wherein the first switching part is configured to couple each of the holding latches to a respective first one of the digital-to-analog converters during a first frame, couple each of the holding latches to a respective second one of the digital-to-analog converters during a second frame, and couple each of the holding latches to a respective third one of the digital-to-analog converters during a third frame, wherein the respective first, second, and third digital-to-analog converters are different digital-to-analog converters, wherein the number of the digital-to-analog converters is larger than the number of the holding latches, and wherein the first switching part is further configured to output at least a part of the data received from each of the holding latches to the respective first one of the digital-to-analog converters such that the data is shifted in a first direction by one or more channels during the first frame, output at least a part of the data received from each of the holding latches to the respective second one of the digital-to-analog converters such that the data is not shifted during the second frame, and output at least a part of the data received from each of the holding latches to the respective third one of the digital-to-analog converters such that the data is shifted in a second direction opposite the first direction by one or more channels during the third frame.

2. The data driving circuit as claimed in claim 1, wherein the first switching part is configured to shift the data in the first direction or the second direction opposite the first direction by one or more channels during the first frame or the third frame, and wherein the first switching part is not configured to shift the data during the second frame.

3. The data driving circuit as claimed in claim 1, wherein the second switching part is configured to transmit the data signals generated by the data located in an ith one of the holding latches to an ith one of the data lines, and wherein i is a natural number.

4. The data driving circuit as claimed in claim 1, wherein the digital-to-analog converters are configured to generate the data signals with voltages corresponding to the data.

5. The data driving circuit as claimed in claim 4, further comprising:

an output stage comprising a plurality of buffers located between the second switching part and the data lines.

6. The data driving circuit as claimed in claim 1, wherein the digital-to-analog converters are configured to generate data signals with currents corresponding to the data.

7. The data driving circuit as claimed in claim 6, further comprising:

an output stage comprising a plurality of sample/hold circuits located between the second switching part and the data lines, the plurality of sample/hold circuits for charging voltages corresponding to the data signals with the currents and receiving the currents via the data lines corresponding to the charged voltages.

8. The data driving circuit as claimed in claim 1, wherein the digital-analog converters are configured to receive currents corresponding to the data via the second switching part and the data lines.

9. The data driving circuit as claimed in claim 1, further comprising a shift register part for generating sampling signals, and wherein the sampling latch part is configured to store the data in response to the sampling signals and to supply the stored data to the holding latch part.

10. The data driving circuit as claimed in claim 1, further comprising:

a level shifter part for raising a voltage level of the data stored in the holding latch.

11. A light emitting display device comprising:

a scan driver for driving scan signals of scan lines;

a data driver for driving data signals of data lines; and a display region comprising a plurality of pixels coupled to the scan lines and the data lines, wherein a data driving circuit of the data driver comprises:

a sampling latch part comprising a plurality of sampling latches for sampling data;

a holding latch part comprising a plurality of holding latches for storing all of the data sampled by the sampling latches;

a signal generation part comprising a plurality of digital-to-analog converters for receiving the data and for generating the data signals;

a first switching part located between the holding latch part and the signal generation part; and a second switching part coupled to the signal generation part, the second switching part being for transmitting the data signals to data lines, wherein the first switching part is configured to couple each of the holding latches to a respective first one of the digital-to-analog converters during a first frame, couple each of the holding latches to a respective second one of the digital-to-analog converters during a second frame, and couple each of the holding latches to a respective third one of the digital-to-analog converters during a third frame, wherein the respective first, second, and third digital-to-analog converters are different digital-to-analog converters, wherein the number of the digital-to-analog converters is larger than the number of the holding latches; and wherein the first switching part is further configured to:

output at least a part of the data received from each of the holding latches to the respective first one of the digital-to-analog converters such that the data is shifted in a first direction by one or more channels during a the first frame, output at least a part of the data received from each of the holding latches to the respective second one of the digital-to-analog converters such that the data is not shifted during the second frame, and output at least a part of the data received from each of the holding latches to the respective third one of the digital-to-analog converters such that the data is shifted in a second direction opposite the first direction by one or more channels during the third frame.

12. The light emitting display device as claimed in claim 11, wherein the second switching part is configured to transmit the data signals generated by the data located in an ith one of the holding latches to an ith one of the data lines, and wherein i is a natural number.

13. A driving method of a light emitting display device, the method comprising:

generating a plurality of data signals using a plurality of digital-to-analog converters;

supplying the data signals via a plurality of data lines to a plurality of pixels; and generating light in the plurality of pixels corresponding to the data signals, wherein a first one of the digital-to-analog converters for supplying at least one of the data signals to a specific one of the data lines during a current frame is different from a second one of the digital-to-analog converters for supplying the at least one of the data signals to the specific one of the data lines during a previous frame, wherein the generating the plurality of data signals comprises:

supplying data to a plurality of sampling latches for sampling the data storing all of the data sampled by the sampling latches using a plurality of holding latches;

supplying the data from the holding latches to a first switch to provide the data to the digital-to-analog converters, wherein the number of the digital-to-analog converters is larger than the number of the holding latches;

coupling each of the holding latches couples to a respective first one of the digital-to-analog converters during a first frame;

coupling each of the holding latches to a respective second one of the digital-to-analog converters during a second frame;

coupling each of the holding latches to a respective third one of the digital-to-analog converters during a third frame, wherein the respective first, second, and third digital-to-analog converters are different digital-to-analog converters;

outputting at least a part of the data received from each of the holding latches to the respective first one of the digital-to-analog converters such that the data is shifted in a first direction by one or more channels during a first frame;

outputting at least a part of the data received from each of the holding latches to the respective second one of the digital-to-analog converters such that the data is not shifted during the second frame; and outputting at least a part of the data received from each of the holding latches to the respective third one of the digital-to-analog converters such that the data is shifted in a second direction opposite the first direction by one or more channels during the third frame.

14. The driving method of a light emitting display device as claimed in claim 13, wherein the generating the plurality of data signals further comprises:

shifing the data stored in each of the holding latches during at least one of the previous frame and the current frame to supply the data to the digital-to-analog converters;

generating the data signals using the data; and shifting the data signals during the at least one of the previous frame and the current frame to supply the data signals to the data lines.

15. The driving method of a light emitting display device as claimed in claim 14, wherein the data are shifted in the first direction or the second direction opposite the first direction by one or more channels during the previous frame, and wherein the data are not shifted during the current frame.

16. The driving method of a light emitting display device as claimed in claim 14, wherein a part of the data is shifted in the first direction by one or more channels and a remaining part of the data is shifted in the second direction by one or more channels during the previous frame, and wherein the data are not shifted during the current frame.

17. The driving method of a light emitting display device as claimed in claim 13, wherein the data signals generated from an ith one of the holding latches located in an ith channel are transmitted to an ith one of the data lines, and wherein i is a natural number.

18. A data driving circuit comprising:

a holding latch unit including holding latches for storing data;

a signal generation part comprising a plurality of digital-to-analog converters for receiving the data and for generating data signals;

a first switching part located between the holding latch part and the signal generation part; and a second switching part coupled to the signal generation part, the second switching part being for transmitting the data signals to data lines, wherein the first switching part is configured to couple each of the holding latches to a respective first one of the digital-to-analog converters during a first frame, couple each of the holding latches to a respective second one of the digital-to-analog converters during a second frame, and couple each of the holding latches to a respective third one of the digital-to-analog converters during a third frame, wherein the respective first, second, and third digital-to-analog converters are different digital-to-analog converters, and wherein the first switching part is further configured to output at least a part of the data received from each of the holding latches to the respective first one of the digital-to-analog converters such that the data is shifted in a first direction by one or more channels during a the first frame, output at least a part of the data received from each of the holding latches to the respective second one of the digital-to-analog converters such that the data is not shifted during the second, and output at least a part of the data received from each of the holding latches to the respective third one of the digital-to-analog converters such that the data is shifted in a second direction opposite the first direction by one or more channels during the third frame.

19. The data driving circuit as claimed in claim 18, wherein during the first frame, the second switching part is configured to shift at least a part of the data in the first direction by one or more channels and to shift at least another part of the data in the second direction by one or more channels, configured not to shift the data during the second frame, and during the third frame, configured to shift at least a part of the data in the first direction by one or more channels and to shift at least another part of the data in the second direction by one or more channels.

* * * * *

UNITED STATES PATENT AND TRADEMARK OFFICE

CERTIFICATE OF CORRECTION

PATENT NO. : 8,018,444 B2
APPLICATION NO. : 11/518042
DATED : September 13, 2011
INVENTOR(S) : Yong Sung Park et al.

It is certified that error appears in the above-identified patent and that said Letters Patent is hereby corrected as shown below:

In the Drawings

| | |
|---|---|
| Sheet 7 of 11, FIG. 5a | Delete Drawing Sheet 7 and substitute therefore the Drawing Sheet, consisting of FIG. 5a, as shown on the attached page.<br>Delete “604” Insert -- 604" --<br>Delete “605” Insert -- 605" --<br>Delete “606” Insert -- 606" -- |
| Sheet 8 of 11, FIG. 5b | Delete Drawing Sheet 8 and substitute therefore the Drawing Sheet, consisting of FIG. 5b, as shown on the attached page.<br>Delete “604” Insert -- 604" --<br>Delete “605” Insert -- 605" --<br>Delete “606” Insert -- 606" -- |
| Sheet 9 of 11, FIG. 5c | Delete Drawing Sheet 9 and substitute therefore the Drawing Sheet, consisting of FIG. 5c, as shown on the attached page.<br>Delete “604” Insert -- 604" --<br>Delete “605” Insert -- 605" --<br>Delete “606” Insert -- 606" -- |

Signed and Sealed this
Second Day of October, 2012

David J. Kappos

David J. Kappos
*Director of the United States Patent and Trademark Office*

In the Drawings (continued)

| | |
|---|---|
| Sheet 10 of 11, FIG. 6 | Delete Drawing Sheet 10 and substitute therefore the Drawing Sheet, consisting of FIG. 6, as shown on the attached page.<br>Delete “600” Insert -- 600' -- |
| Sheet 11 of 11, FIG. 7 | Delete Drawing Sheet 11 and substitute therefore the Drawing Sheet, consisting of FIG. 7, as shown on the attached page.<br>Delete “600” Insert -- 600" -- |

In the Claims

| | |
|---|---|
| Column 11, Claim 11, line 17. | After “during”<br>Delete “a” |
| Column 11, Claim 13, line 51. | Delete “data”<br>Insert -- data; -- |
| Column 11, Claim 13, line 59. | Delete “couples” |
| Column 13, Claim 18, line 8. | After “during”<br>Delete “a” |
| Column 13, Claim 18, line 13. | After “second”<br>Insert -- frame -- |